United States Patent [19]

Ohinata et al.

[11] Patent Number: 4,487,555

[45] Date of Patent: Dec. 11, 1984

[54] HERMETIC MOTOR COMPRESSOR

[75] Inventors: Okinobu Ohinata; Takuho Hirahara; Keiju Sakaino; Yawara Uzawa; Nobuhiro Shimizu; Shigeru Shida, all of Shizuoka, Japan

[73] Assignee: Mitsubishi Denki Kabushiki Kaisha, Tokyo, Japan

[21] Appl. No.: 330,466

[22] Filed: Dec. 14, 1981

[30] Foreign Application Priority Data

| | | | |
|---|---|---|---|
| Feb. 13, 1981 | [JP] | Japan | 56-19699 |
| Jun. 26, 1981 | [JP] | Japan | 56-99328 |
| Jul. 7, 1981 | [JP] | Japan | 56-105910 |

[51] Int. Cl.[3] ..... F04B 21/00; F04B 39/00; F04B 39/06

[52] U.S. Cl. ..... 417/312; 417/363; 417/371; 417/373; 417/415; 417/902

[58] Field of Search ..... 417/312, 363, 366, 371–373, 417/415, 902, 313

[56] References Cited

U.S. PATENT DOCUMENTS

| | | | |
|---|---|---|---|
| 2,435,108 | 1/1948 | Touborg | 417/372 |
| 3,167,293 | 1/1965 | Stenger et al. | 417/902 |
| 3,689,203 | 9/1972 | Vaughn | 417/902 X |
| 3,857,652 | 12/1974 | Thayer | 417/312 |
| 4,277,955 | 7/1981 | Parker | 417/902 |
| 4,352,642 | 10/1982 | Murayama et al. | 417/902 |
| 4,382,749 | 5/1983 | Teegarden et al. | 417/415 X |

FOREIGN PATENT DOCUMENTS

| | | | |
|---|---|---|---|
| 45716 | 11/1977 | Japan | 417/312 |

*Primary Examiner*—William L. Freeh
*Assistant Examiner*—Paul F. Neils
*Attorney, Agent, or Firm*—Oblon, Fisher, Spivak, McClelland & Maier

[57] ABSTRACT

A hermetic motor compressor including a closed housing which covers motor and compressor means; and a partition wall which separates a lower temperature compartment in which at least part of a motor is held and a recycling coolant is fed through an inlet port formed on said housing; and a higher temperature compartment in which a compressor and a coolant muffler and a loop part of an outlet pipe are held.

18 Claims, 11 Drawing Figures

HERMETIC MOTOR COMPRESSOR

BACKGROUND OF THE INVENTION

1. Field of the Invention

The present invention relates to an improvement of a hermetic motor compressor in which a coolant gas recycled into a closed housing is fed into a compartment separated from a cylinder head of a compressor, a coolant muffler connected to the cylinder head and an outlet pipe.

2. Description of the Prior Art

FIG. 1 shows a conventional hermetic motor compressor. As shown in FIG. 1, a compressor (2) and a motor (3) are held in a hermetic housing (1) under the condition that the compressor (2) is directly connected through a crankshaft (4) to the motor (3) and the compressor (2) is placed at lower position. A recycling coolant gas is fed through an inlet pipe (5) connected to the housing (1) into the housing and is diffused as shown by arrow lines and is passed through an inlet hole (6*a*) of a motor cover (6) and an inner part of the motor (3) and further is passed through an inlet port (7) into the compressor (2) to be compressed at high temperature under high pressure and is passed through a cylinder head (8) and a coolant muffler (9) connected to the cylinder head and is discharged out of the housing (1) through an outlet pipe (10).

The cold coolant gas diffused in the housing (1) heat-exchanges to the outlet pipe (10), the muffler (9), the cylinder head (8) and a lubricant oil (11) and is fed into the inlet hole (6*a*) of the motor cover (6). Therefore, the coolant gas is heated to have a large specific volume whereby a compression efficiency of the compressor is disadvantageously inferior.

There is another conventional hermetic motor compressor in which the inlet pipe (5) and the inlet hole (6*a*) of the motor cover (6) are coaxially placed to face each other (not shown) so as to prevent the diffusion of the coolant gas in the housing (1). In this case, if a coolant liquid is fed through the inlet pipe (5), the coolant liquid is directly fed through the inlet hole of the motor cover into the compressor (2) whereby a liquid compression phenomenon is resulted to disadvantageously damage parts of the compressor and the bearing.

SUMMARY OF THE INVENTION

It is an object of the present invention to overcome the disadvantages of the conventional hermetic motor compressor and to improve a compression efficiency of a compressor and to prevent a damage of a compressor.

The foregoing and other objects have been attained by placing a partition wall in a housing of the hermetic motor compressor to feed the coolant gas into a lower temperature compartment separated from a higher temperature compartment in which a loop part of an outlet pipe, a muffler and a cylinder head at high temperature are held.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

DETAILED DESCRIPTION OF THE PREFERRED EMBODIMENTS

Figure 1:
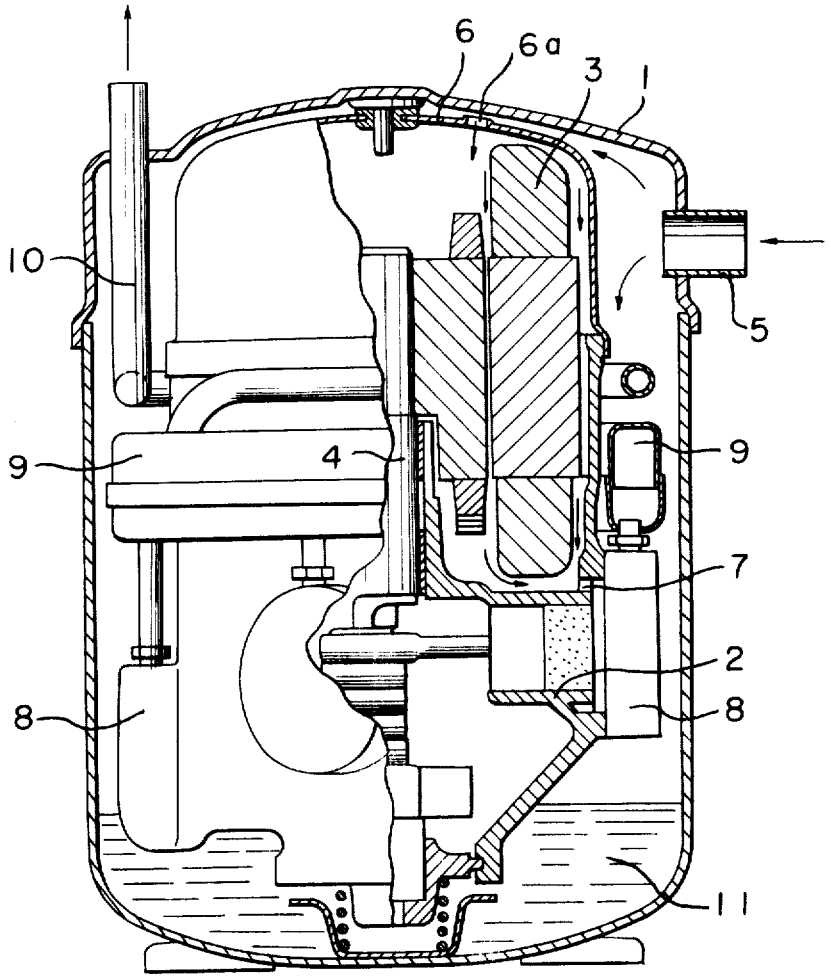
FIG. 1 PRIOR ART
FIG. 1 is a partially sectional view of a conventional hermetic motor compressor.
Figure 2:
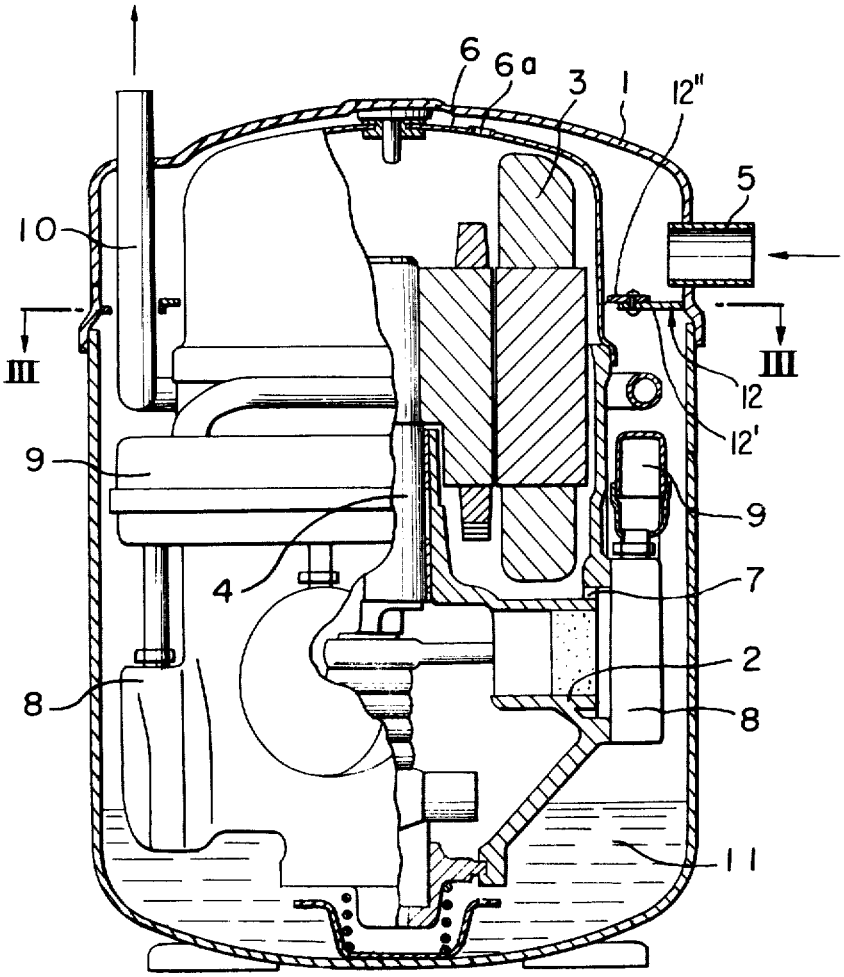
FIG. 2 is a partially sectional view of one embodiment of the hermetic motor compressor of the present invention.
Figure 3:
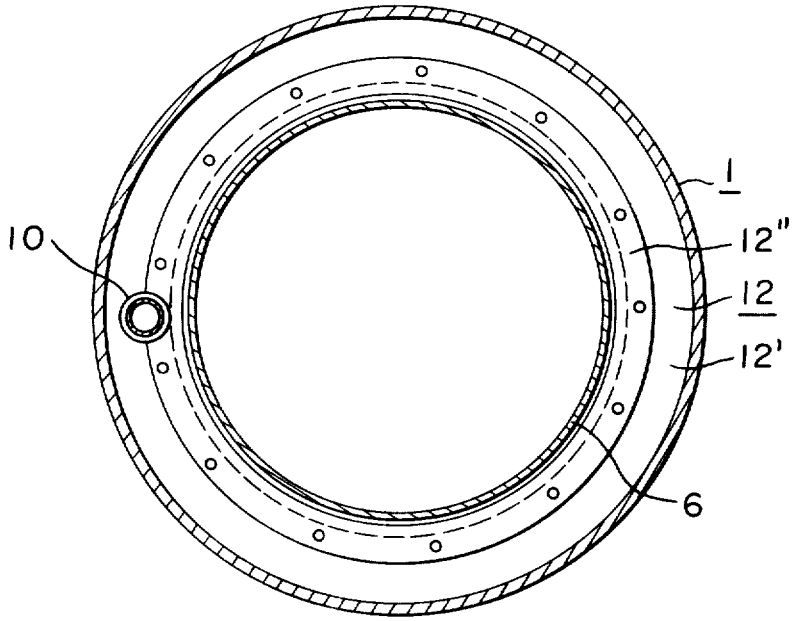
FIG. 3 is a sectional view taken along the line of III—III of FIG. 2.

Referring to FIGS. 2 and 3, the basic concept of the present invention will be illustrated.

A partition wall (12) is placed in the hermetic housing (1) to separate a lower temperature compartment from a higher temperature compartment in which the cylinder head (8) of the compressor (2), the coolant muffler (9) and the loop part of the outlet pipe (10) at high temperature are held.

The partition wall (12) is usually a partition annular sheet fitted on the inner wall of the housing (1) so as to partition the space between the inner wall of the housing and the outer wall of the motor cover (6). The shape of the partition wall (12) is modified depending upon the configuration of the inner wall of the housing and the outer wall of the motor cover. The partition wall (12) may have a hole for inserting the end of the outlet pipe (10).

As one embodiment, the partition wall (12) can be formed by an annular rigid fitting part (12') made of a steel sheet etc. which is mounted on the inner wall of the housing (1) and an annular elastic sheet (12'') of a rubber sheet etc. which is mounted on the fitting part (12') by riveting. The free edge of the elastic sheet (12'') of the partition wall (12) can have a small gap such as about 1 mm from the outer wall of the motor cover (6). A gap between the partition wall (12) and the outlet pipe can be in a range of 1 to 3 mm.

Figure 4:
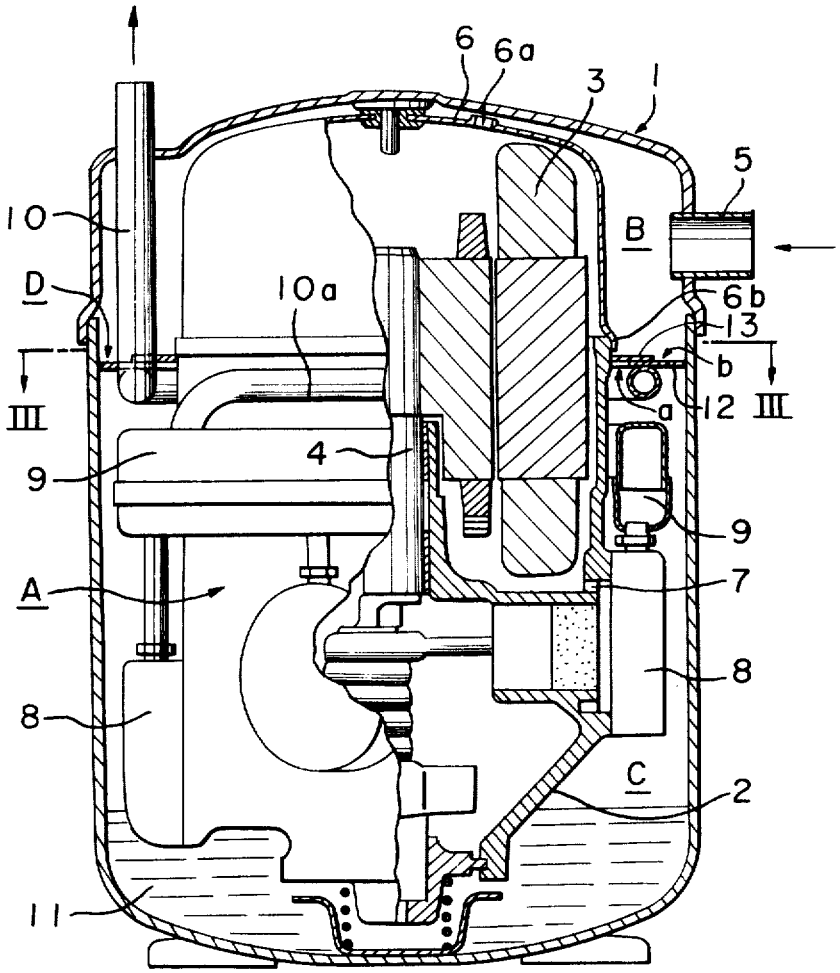
FIG. 4 is a partially sectional view of another embodiment of the hermetic motor compressor of the present invention.
Figure 5:
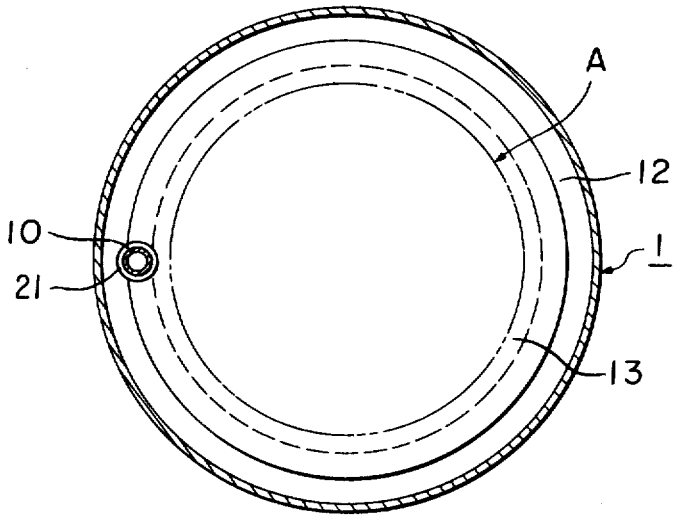
FIG. 5 is a sectional view taken along the line of III—III of FIG. 4.
Figure 6:
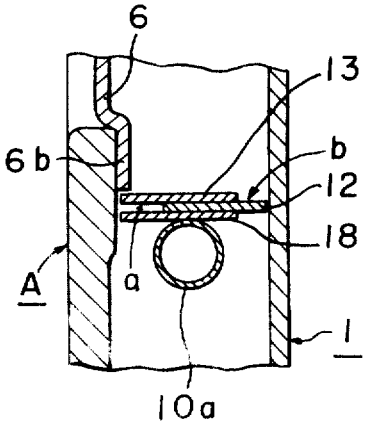

Referring to FIGS. 4, 5 and 6, the other embodiment of the present invention will be illustrated.

The partition wall (12) is an annular outer partition sheet which is held in the housing with a small gap such as about 0.5 mm between the outer peripheral part and the inner wall of the housing (1) and a small gap such as about 3 to 8 mm between the inner peripheral part and the outer wall of the body of the motor (3) and compressor means which substantially corresponds to the mutual movement of the motor and compressor means (A) with respect to the housing (1) in the transportation or at the starting or stopping. The annular partition sheet (12) can be placed on the horizontal loop part (10*a*) of the outlet pipe (10). An annular inner partition sheet (13) is held with a small gap such as 0.5 mm between the inner peripheral part and the outer wall of the body of the motor and compressor means and with a gap between the outer peripheral part and the inner wall of the housing (1) which allows the free mutual movement of the motor and compressor means (A) with respect to the housing (1) in the transportation, or at the starting or stopping. The annular inner partition sheet (13) is superposed to the partition sheet (12) whereby the annular partition wall (D) as the pair of the outer partition sheet (12) and the inner partition sheet (13) which is expandable in the horizontal direction is formed to separate the upper lower temperature compartment (B) from the lower higher temperature compartment (C) in the closed housing (1).

In FIG. 5, a gap (21) is formed between the outlet pipe (10) and the partition sheets (12), (13) and is usually about 1 to 3 mm. The partition sheet (13) is pushed down by the edge (6*b*) of the motor cover (6).

In accordance with the embodiment, the inside of the hermetic housing (1) is separated by the annular partition wall (D) into the upper lower temperature compartment (B) and the lower higher temperature compartment (C) with a small gap. Therefore, the most of the cold coolant gas fed through the inlet pipe (5) is fed through the inlet hole (6*a*) of the motor cover (6) into the inlet port (7) of the compressor (2) without substantial heat-exchange to the parts at high temperature such as the loop part (10*a*) of the outlet pipe, the muffler (9) and the cylinder head (8) kept in the higher temperature compartment (C) whereby the heating of the coolant gas can be reduced to be less specific volume and therefore the amount of low specific volume recycling coolant gas is increased to improve the efficiency of the compressor in comparison with the conventional closed motor compressor. Even though a coolant liquid is fed through the inlet pipe (5), the coolant liquid passes down through the gaps of the annular partition wall (D) in both sides whereby the coolant liquid is not fed into the compressor (2).

Moreover, in the case of the vibration of the motor and compressor means (A) in the housing in the transportation or at the starting or stopping of the compressor, the vibration of the motor and compressor means (A) can be free to prevent any deformation of the partition wall (D) caused by the corrosion because of the gaps (a), (b) of the partition wall (D). Moreover, the edge (6*b*) of the motor cover (6) is the stopper of the partition wall (D) whereby the upper movement of the partition wall (D) is prevented.

Figure 7:
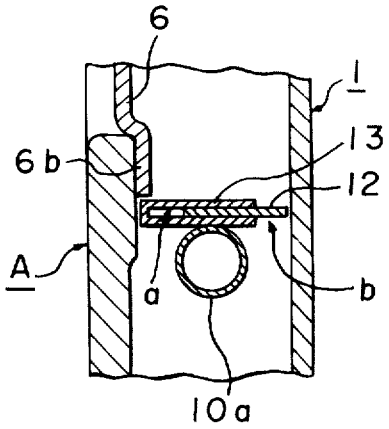
FIGS. 6 and 7 are respectively partially enlarged sectional views of the other embodiments of the partition wall.

FIGS. 6 and 7 shows the other embodiments of the partition wall of FIG. 5. In FIG. 6, the annular partition wall has the three layer structure having an auxiliary sheet (18) for partitioning.

In FIG. 7, the annular inner partition sheet (13) has a structure having a sectional view of ⊏ shape and the annular outer partition sheet (12) is inserted into the groove of the inner partition sheet (13).

Figure 8:
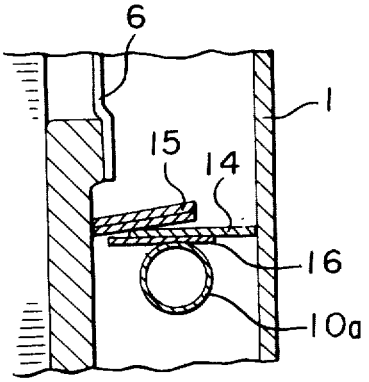
FIG. 8 is partially enlarged sectional view of the other embodiment of the partition wall.
Figure 9:
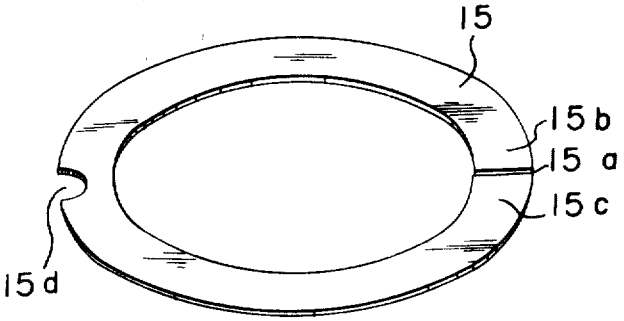
FIGS. 9 and 10 are respectively schematic views of the partition wall of FIG. 8.
Figure 10:
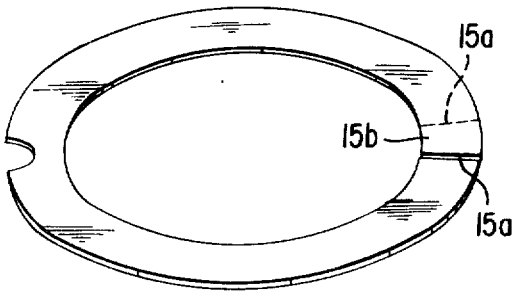

Referring to FIGS. 8, 9 and 10, the other embodiment of the hermetic motor compressor will be illustrated.

An annular auxiliary partition sheet (16) is placed with a desired gap between the outer peripheral part and the inner wall of the housing (1) and with a desired gap between the inner peripheral part and the outer wall of the body of the motor and compressor means. The auxiliary partition sheet (16) is placed on the loop part (10*a*) of the inlet pipe (10). An annular outer partition sheet (14) is held with a small gap such as 0.5 mm or less between the outer peripheral part and the inner wall of the housing and with a gap between the inner peripheral part and the outer wall of the body of the motor and compressor means which allows the free mutual movement of the motor and compressor means (A) with respect to the housing (1) in the transportation or at the starting or stopping. The outer partition sheet (14) is placed on the auxiliary partition sheet (16). An annular inner partition sheet (15) shown in FIG. 9 has a recess (15*d*) for the outlet pipe (10) and a cut line (15*a*). The end (15*b*) and the other end (15*c*) formed by the cut line (15*a*) are superposed as shown in FIG. 10 and the superposed part is fixed whereby the inner partition sheet (15) is fitted to the outer wall of the body of the motor and compressor means without a gap between the inner peripheral part and the outer wall of the body and with a gap between the outer peripheral part and the inner wall of the housing (1) which allows the free mutual movement of the motor and compressor means (A) with respect to the housing (1).

Figure 11:
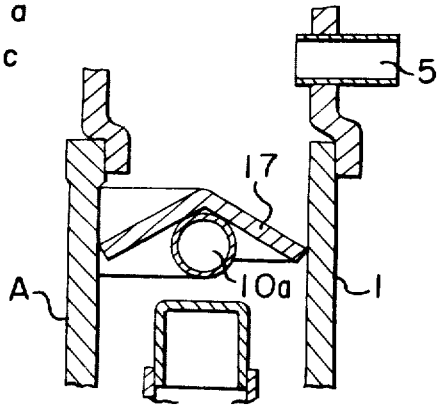
FIG. 11 is a partially enlarged sectional view of the other embodiment of the partition wall.

Referring to FIG. 11, the other embodiment of the partition wall will be illustrated.

In this embodiment, the partition wall is an annular partition sheet (17) which has a gap between the outer peripheral part and the inner wall of the housing (1) and with a gap between the inner peripheral part and the outer wall of the body of the motor and compressor means (A) and which is placed on the loop part (10*a*) of the outlet pipe (10) by dead weight.

The partition sheet (17) preferably has a curved or bent sectional view as shown in 11.

The partition sheet (17) can be easily mounted because it is only put on the loop part of the outlet pipe in the assembling.

When the partition sheet (17) is made of a plastic, a noise is not resulted even though the partition sheet repeatedly contacts with the motor and compressor means at the starting or stopping of the compressor.

In accordance with the present invention, the hermetic housing holding the motor and compressor means is partitioned by an annular partition wall surrounding the body of the motor and compressor means into the lower temperature compartment and the higher temperature compartment whereby the coolant gas fed into the lower temperature compartment is separated from the higher temperature compartment in which the loop part of the outlet pipe, the muffler and the cylinder head of the compressor are held. Therefore, the heating of the fed coolant gas is prevented to improve the compression efficiency of the compressor.

The structures of partition wall are considered to prevent a noise caused by vibration of the motor and compressor means especially at the starting and stopping of the compressor.

Obviously, numerous modifications and variations of the present invention are possible in light of the above teachings. It is therefore to be understood that within the scope of the appended claims, the invention may be practiced otherwise than as specifically described herein.

We claim:

1. A hermetic motor compressor which comprises:

(a) a closed housing which covers a motor and a compressor means, said closed housing having an inlet port formed therein for a recycling coolant;

(b) a partition wall which separates a lower temperature compartment into which said inlet port opens and a higher temperature compartment within said closed housing, said lower temperature compartment containing at least a part of said motor, said higher temperature compartment containing said compressor means, a coolant muffler, and a loop part of an outlet pipe, and said partition wall being made of an elastic material; and (c) a fitting for supporting said partition wall, said fitting being mounted on said closed housing and being made of a rigid material.

2. A hermetic motor compressor as recited in claim 1 wherein said partition wall is riveted to said fitting.

3. A hermetic motor compressor as recited in claim 1 wherein:

(a) a motor cover covers said motor in said lower temperature compartment and extends into said higher temperature compartment;

(b) said partition wall extends from said closed housing toward said motor cover, but there is a small gap between said partition wall and said motor cover; and (c) said outlet pipe extends through said partition wall and said fitting, and there is a small gap between said outlet pipe and said partition wall and said fitting.

4. A hermetic motor compressor which comprises:

(a) a closed housing which covers a motor and a compressor means, said closed housing having an inlet port formed therein for a recycling coolant, and (b) a partition wall which separates a lower temperature compartment onto which said inlet port opens and a higher temperature compartment within said closed housing, said lower temperature compartment containing at least a part of said motor, said higher temperature compartment containing said compressor means, a coolant muffler, and a loop part of an outlet pipe, and said partition wall being an expansion partition wall.

5. A hermetic motor compressor as recited in claim 4 wherein said partition wall is supported on said loop part of an outlet pipe.

6. A hermetic motor compressor as recited in claim 4 wherein:

(a) said motor is at least partially surrounded by an outer wall which extends into both said lower temperature compartment and said higher temperature compartment;

(b) said partition wall extends between said closed housing and said outer wall, but there is a small gap between said partition wall and said closed housing and another small gap between said partition wall and said outer wall; and (c) said outlet pipe extends through said partition wall and there is a small gap between said outlet pipe and said partition wall.

7. A hermetic motor compressor which comprises:

(a) a closed housing which covers a motor and a compressor means, said closed housing having an inlet port formed therein for a recirculating coolant;

(b) an upwardly open outer wall which at least partially surrounds said motor;

(c) a downwardly open motor cover which extends over the top of said motor and fits over the outside of said upwardly open outer wall; and (d) a partition wall which separates a lower temperature compartment into which said inlet port opens and a higher temperature compartment within said closed housing, said lower temperature compartment containing at least a part of said motor and said higher temperature compartment containing said compressor means, a coolant muffler, and a loop part of an outlet pipe, said partition wall extending between said closed housing and said outer wall beneath said motor cover, said partition wall extending beneath the bottom surface of said motor cover, whereby said motor cover prevents upward movement of said partition wall.

8. A hermetic motor compressor as recited in claim 7 wherein there is a small gap between said partition wall and said closed housing and another small gap between said partition wall and said outer wall.

9. A hermetic motor compressor as recited in claim 7 wherein said outlet pipe extends through said partition wall and there is a small gap between said outlet pipe and said partition wall.

10. A hermetic motor compressor as recited in claim 7 wherein said partition wall is supported on said loop of an outlet pipe.

11. A hermetic motor compressor including motor means, compressor means, a hermetic housing enclosing said motor means and said compressor means and including an inlet port formed therethrough for feeding a recycling coolant into said hermetic housing in the vicinity of said motor means, an outlet pipe having a loop portion, and a coolant muffler, said hermetic motor further comprising:

an annular partition wall superposed over said loop portion of said outlet pipe to define a low temperature compartment having a portion of said motor means disposed therein and a high temperature compartment having said compressor means, said coolant muffler, and said loop portion of said output pipe disposed therein, said annular partition wall being disposed so that an outer periphery of said partition wall forms a small predetermined gap with an inner surface of said hermetic housing and an inner periphery of said partition wall is fitted against an outer surface of said compressor means, said annular partition wall being an expandable annular partition wall.

12. The hermetic motor compressor as claimed in claim 11 wherein said annular partition wall is further disposed so as to be held against a body of said compressor means.

13. The hermetic motor compressor as claimed in claim 11 wherein said annular partition wall further comprises an outer partition wall having said outer periphery and forming said small predetermined gap with said inner surface of said hermetic housing and an inner partition wall having said inner periphery fitted against said outer surface of said compressor means and wherein an outer peripheral portion of said inner partition is superposed to said outer partition wall.

14. The hermetic motor compressor as claimed in claim 11 wherein said annular partition wall superposed with said loop portion of said outlet pipe is held on said loop portion.

15. The hermetic motor compressor as claimed in claim 11 wherein said inner periphery of said partition wall is fitted against said outer surface of said compressor means at a position adjacent to a motor cover opening end of said motor means.

16. The hermetic motor compressor as claimed in claim 11 wherein said partition wall further comprises an annular auxiliary partition wall held on said loop portion and wherein said annular auxiliary partition wall is disposed so as to define a first predetermined gap between an outer periphery of said annular auxiliary partition wall and said inner surface of said hermetic housing, and a second predetermined gap between an inner periphery of said annular auxiliary partition wall and said outer surface of said compressor means.

17. A hermetic motor compressor which comprises:

(a) a closed housing which covers a motor and a compressor means, said closed housing having an inlet port formed therein for recycling coolant;

(b) a partition wall which separates a lower temperature compartment into which said inlet port opens and a higher temperature compartment within said closed housing, said lower temperature compartment containing at least a part of said motor and said higher temperature compartment containing said compressor means, a coolant muffler, and a loop part of an outlet pipe, said partition wall comprising an annular outer partition wall and annular inner partition wall which is superposed upon said annular outer partition wall and which is radially inwardly offset from said annular outer partition wall; and (c) a motor cover which at least partially surrounds said motor and which extends into both said lower temperature compartment and said higher temperature compartment, said partition wall extending between said closed housing and said motor cover, there being a small gap between said annular outer partition wall and said closed housing and another small gap between said annular inner partition wall and said motor cover.

18. A hermetic motor compressor as recited in claim 17 wherein said outlet pipe extends through said partition wall and there is a small gap between said outlet pipe and said partition wall.

* * * * *